US009314117B2

(12) United States Patent
Keil

(10) Patent No.: US 9,314,117 B2
(45) Date of Patent: Apr. 19, 2016

(54) HANGING BASKET COVER

(71) Applicant: Ken Keil, Chicago, IL (US)

(72) Inventor: Ken Keil, Chicago, IL (US)

( * ) Notice: Subject to any disclaimer, the term of this patent is extended or adjusted under 35 U.S.C. 154(b) by 269 days.

(21) Appl. No.: 13/827,410

(22) Filed: Mar. 14, 2013

(65) Prior Publication Data

US 2014/0259917 A1 Sep. 18, 2014

(51) Int. Cl.

| | |
|---|---|
| ***A47G 7/00*** | (2006.01) |
| ***A47G 7/08*** | (2006.01) |
| ***A47G 7/04*** | (2006.01) |

(52) U.S. Cl.
CPC . *A47G 7/08* (2013.01); *A47G 7/047* (2013.01)

(58) Field of Classification Search
CPC ..... A01G 9/024; A47G 7/047; A47G 7/045; A47G 7/08; A47G 7/085
USPC ..... 47/67, 41.01, 72; 248/315, 312, 318; 211/85.23, 85.29; D11/143, 148
See application file for complete search history.

(56) References Cited

U.S. PATENT DOCUMENTS

| | | | | | |
|---|---|---|---|---|---|
| 2,355,559 | A | | 8/1944 | Renner | |
| 3,818,633 | A | | 6/1974 | Sable | |
| 4,229,904 | A | * | 10/1980 | Burton | 47/58.1 R |
| 4,914,860 | A | | 4/1990 | Richardson | |
| D320,765 | S | | 10/1991 | Sypien | |
| 5,052,149 | A | * | 10/1991 | Johnson | A01G 27/00 222/181.3 |
| 5,088,234 | A | * | 2/1992 | Wong | 47/67 |
| 5,193,304 | A | * | 3/1993 | Krueger | 47/67 |
| 5,303,506 | A | | 4/1994 | Weder et al. | |
| 5,870,856 | A | | 2/1999 | Friend | |
| D424,974 | S | | 5/2000 | Cook | |
| D627,682 | S | | 11/2010 | Soli | |
| 2002/0184821 | A1 | | 12/2002 | Campeau | |
| 2004/0231241 | A1 | * | 11/2004 | Lepoutre | 47/72 |
| 2006/0277824 | A1 | | 12/2006 | Clair | |
| 2009/0158653 | A1 | * | 6/2009 | Oliver et al. | 47/66.2 |

* cited by examiner

*Primary Examiner* — Joshua Huson
(74) *Attorney, Agent, or Firm* — Greer, Burns & Crain, Ltd.

(57) ABSTRACT

A hanging basket cover including a body having a first, open end and an opposing second end, and at least two flexible arms transversely extending from the first end of the body. The arms are movable between a rest position and a flexed position, where a hanging basket is inserted in the first end of the body and against the flexible arms causing the flexible arms to move to the flexed position for allowing the hanging basket to move into the body until the flexible arms extend over a top edge of the hanging basket to secure the body to the hanging basket.

14 Claims, 8 Drawing Sheets

HANGING BASKET COVER

BACKGROUND

Hanging baskets are used to hold flowers and plants and are attached to and hang from a hook or similar device at a position above the ground. These baskets are generally made of plastic and typically solid colors such as green or white. Because conventional hanging baskets are not aesthetically appealing, there are different decorative covers that have been made to cover the outside surfaces of the baskets. These covers are made of different materials, such as fabric, and also come in different shapes.

Many of the conventional covers, however, are difficult to mount to a hanging basket and therefore require significant time and effort by a user to attach the covers to the baskets. Furthermore, covers made with absorbent materials such as fabric materials get dirty and wet over time thereby diminishing the aesthetic appeal of these covers.

Accordingly, there is a need for an aesthetically appealing, durable decorative cover for a hanging basket that is easily mounted to and removed from the basket.

SUMMARY

The present hanging basket cover provides a removable and replaceable decorative cover that can be easily and quickly placed over and secured to a conventional hanging basket.

In an embodiment, the present hanging basket cover includes a body having a first, open end and an opposing second end, and at least two flexible arms transversely extending from the first end of the body. The arms are movable between a rest position and a flexed position, where a hanging basket is inserted in the first end of the body and against the flexible arms causing the flexible arms to move to the flexed position for allowing the hanging basket to move into the body until the flexible arms extend over a top edge of the hanging basket to secure the body to the hanging basket.

In another embodiment, the present hanging basket cover provides a body including an open end and at least two arms adjacent to the open end, the arms transversely extending from and being hingedly connected to the body, where the at least two arms move between a rest position and one of an upward flexed position and a downward flexed position. A hanging basket is inserted into the open end and against the at least two arms, causing the at least two arms to move from the rest position to the downward flexed position for allowing the hanging basket to move into the body until the at least two arms extend over a top edge of the hanging basket and move to the rest position for securing the body to the hanging basket. The body is removed from the hanging basket by moving the body downwardly relative to the hanging basket causing the at least two arms to move to the upward flexed position until body is separated from the hanging basket.

DETAILED DESCRIPTION

The present invention provides a removable decorative cover for a hanging basket that is easily and quickly placed over and secured to a hanging plant or flower basket.

Figure 1:
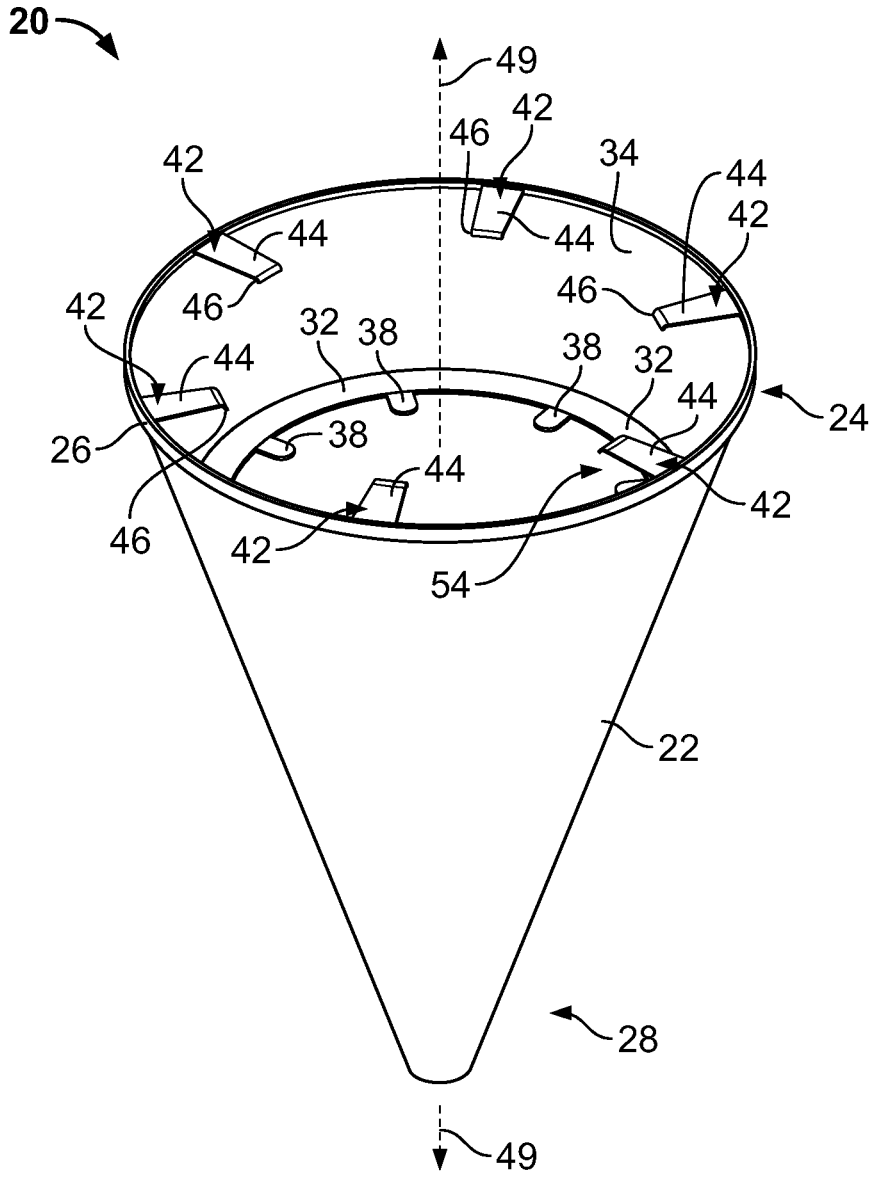
FIG. 1 is a perspective view of an embodiment of the present hanging basket cover.
Figure 2:
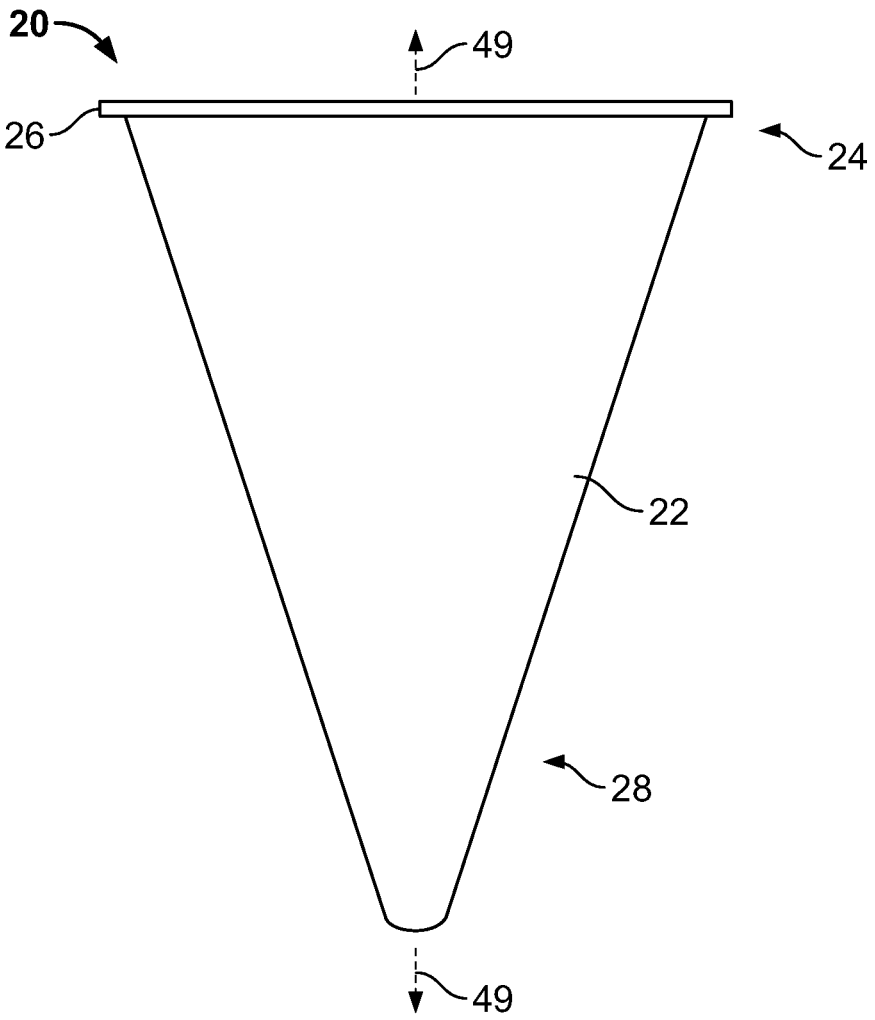
FIG. 2 is a front view of the cover of FIG. 1, the rear view being a mirror image thereof.
Figure 3:
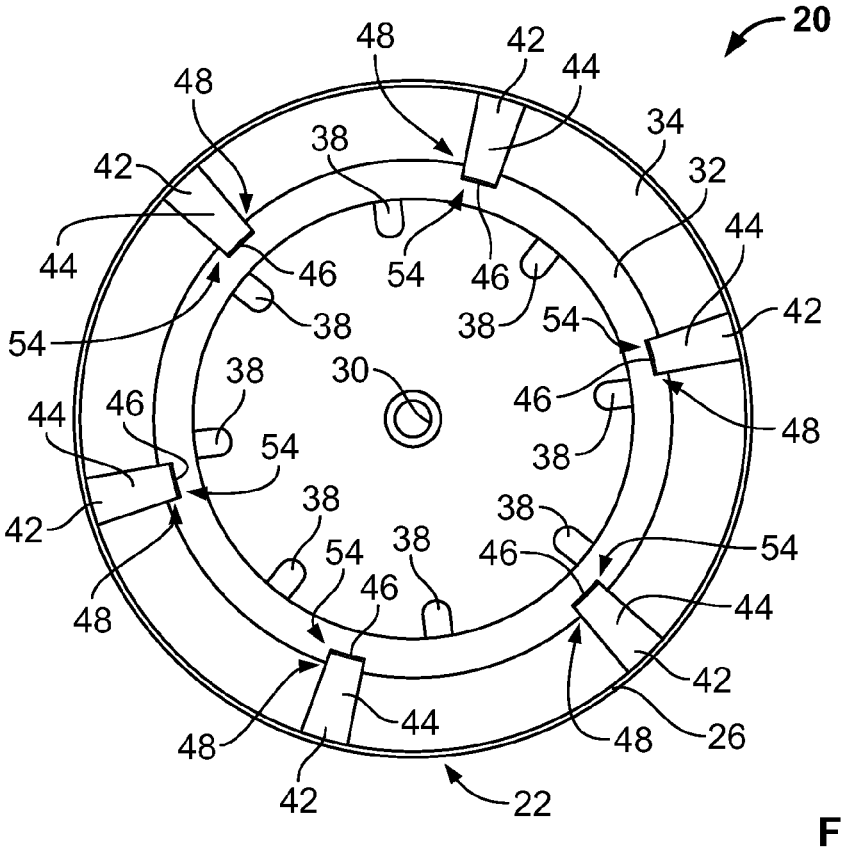
FIG. 3 is a top view of the cover of FIG. 1.
Figure 4:
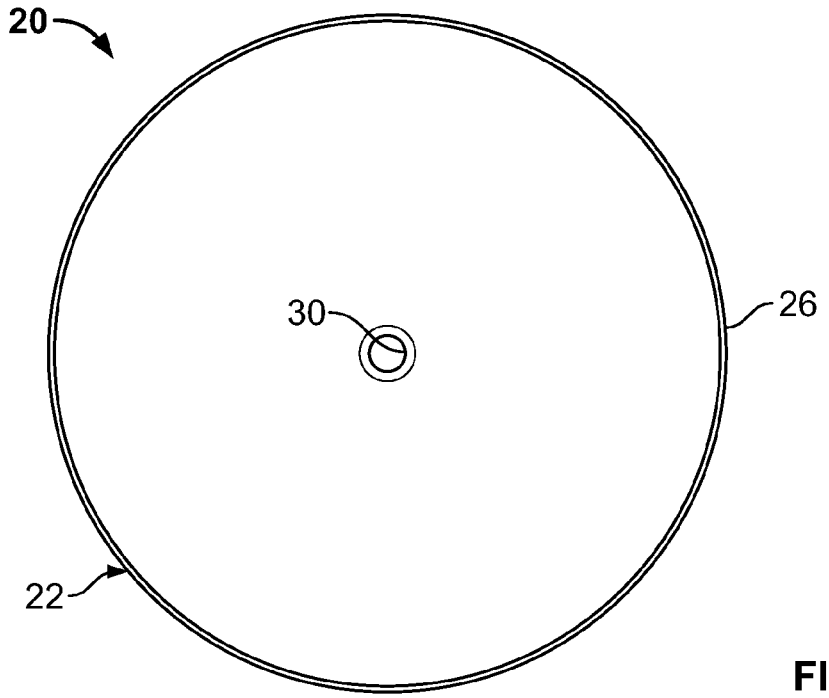
FIG. 4 is a bottom view of the cover of FIG. 1.

Referring now to FIGS. 1-8, the present hanging basket cover generally indicated as 20, includes an integrally formed body 22 made of a durable material such as plastic, ethylene vinyl acetate (EVA) or other suitable material or combination of materials. The material forming the body 22 is also preferably waterproof to prevent degradation of the cover 20 over time due to water draining from the basket and environmental elements. In FIG. 1, the body 22 has a cone shape but it is contemplated that the body may have a truncated cone shape, a rounded shape or any other suitable shape. In the present embodiment, the body 22 includes an open first end or top end 24 having a top edge 26 and an opposing second end or bottom end 28. The bottom end 28 includes at least one opening 30 as shown in FIG. 4 for allowing water to drain out of the cover. It should be appreciated that the bottom end 28 of the cover 20 may have one opening or a plurality of openings.

A support ring 32 is integrally formed with an inner surface 34 of the body 22 and is positioned at a designated distance below the top edge 26 of the body for centering a basket 36 within the cover. Preferably, the support ring 32 is positioned at a distance below the top edge 26 of the body 22 so that the ring contacts a middle portion to lower portion of the basket. It should be appreciated that the support ring 32 may be mounted at any suitable position relative to the basket 34 on the inner surface 34 of the body 22. The support ring 32 is preferably made of plastic, EVA or other suitable material and is integrally formed with and extends around the entire inner peripheral surface of the body 22. In another embodiment, the support ring 32 is segmented or has two or more spaced parts that are attached to the inner surface 34 of the body 22. As best shown in FIG. 3, the support ring 32 includes a plurality of flexible tabs 38 that are integrally formed with and radially extend from the support ring 32. The tabs 38 contact an outer surface 40 of the basket 36 as it is inserted into the cover 20 for centering the basket within the cover. In the illustrated embodiment, the support ring 32 includes eight of the flexible tabs 38 (FIG. 3). It should be appreciated that the support ring 32 may include two of the flexible tabs (FIG. 9) or a plurality of the flexible tabs. It should also be appreciated that the support ring 32 and the tabs 38 may be made out of the same material or different materials. For example, the support ring 32 may be made out of a durable plastic and the tabs 38 made out of a resilient rubber or EVA.

As shown in FIGS. 1, 3 6 and 8, a plurality of flexible connecting tabs or arms 42 transversely extend from the top edge 26 of the body 22. Each of the arms 42 includes a generally planar member 44 and a stop 46 transversely extending from an end 48 of the planar member. As further explained below, the stops 46 limit lateral movement of the cover 20 relative to the hanging basket 36 when the cover is secured to the hanging basket. This helps to prevent the basket 36 from inadvertently separating from the cover 20. Preferably, the arms 42 are spaced equidistant from each other about the periphery of the body 22. For example in FIG. 1, the arms are spaced 60° apart from each other relative to a central longitudinal axis 49 defined by the body 22. It should be appreciated that the arms 42 may be spaced at any suitable distance from or at any angle relative to each other.

Figure 8:
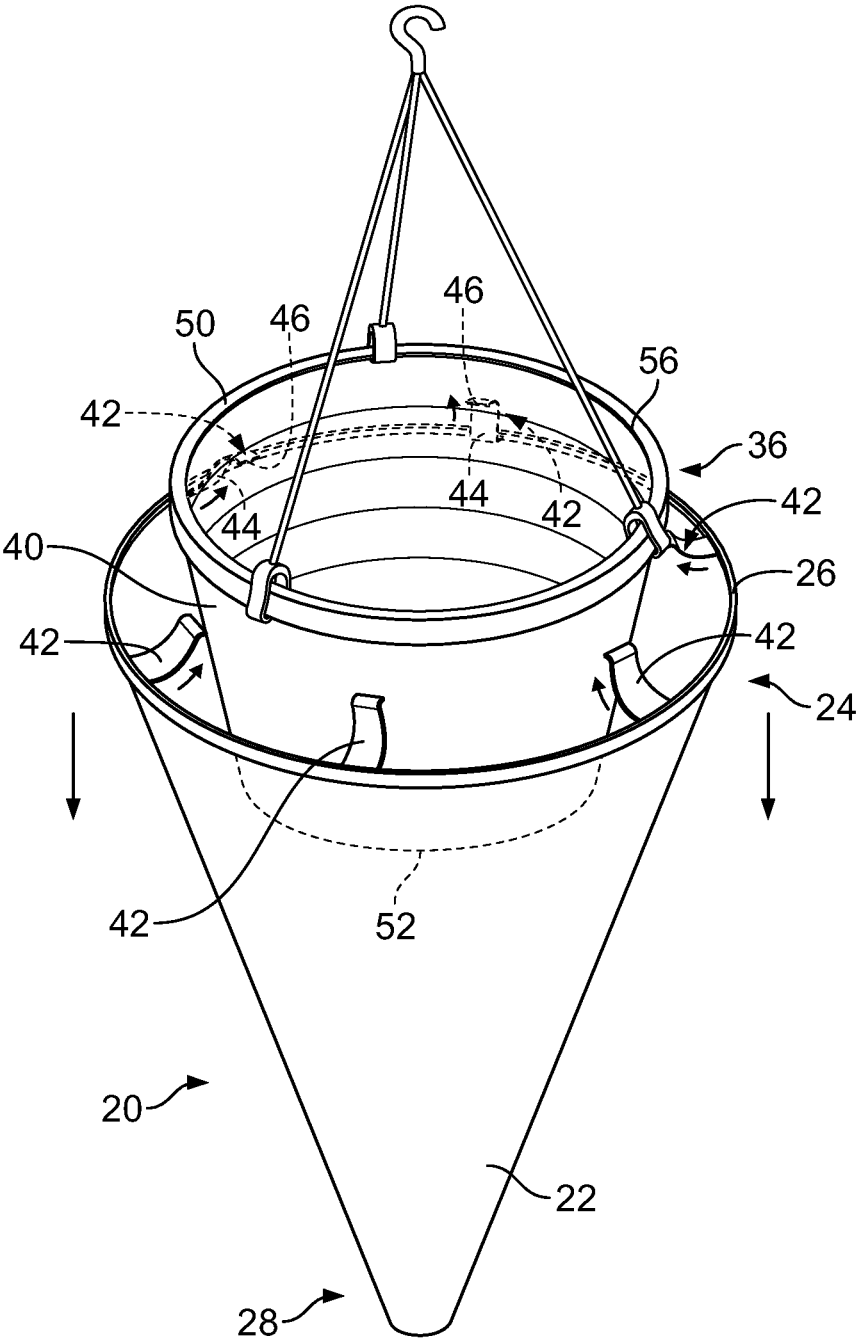
FIG. 8 is a perspective view of the cover of FIG. 5 being removed from the hanging basket.

In the present embodiment, the arms 42 are made of a flexible material such as a flexible plastic that allows each of the arms to flex or pivot upwardly or downwardly relative to the top edge 26 of the body 22. As further described below, each of the arms 42 moves or flexes between a rest position (FIG. 1), a substantially, downwardly flexed position (FIG. 6) or a substantially, upwardly flexed position (FIG. 8). The flexible, resilient material forming the arms 42 causes the arms to spring back or return to the rest position (FIG. 1) after moving to either the upwardly flexed position or the downwardly flexed position. In another embodiment, the arms 42 are connected to the top edge 26 of the body 22 by a biased hinge or similar connector and pivot between the rest position, the upwardly flexed position or the downwardly flexed position where the arms are biased to the rest position.

Figure 5:
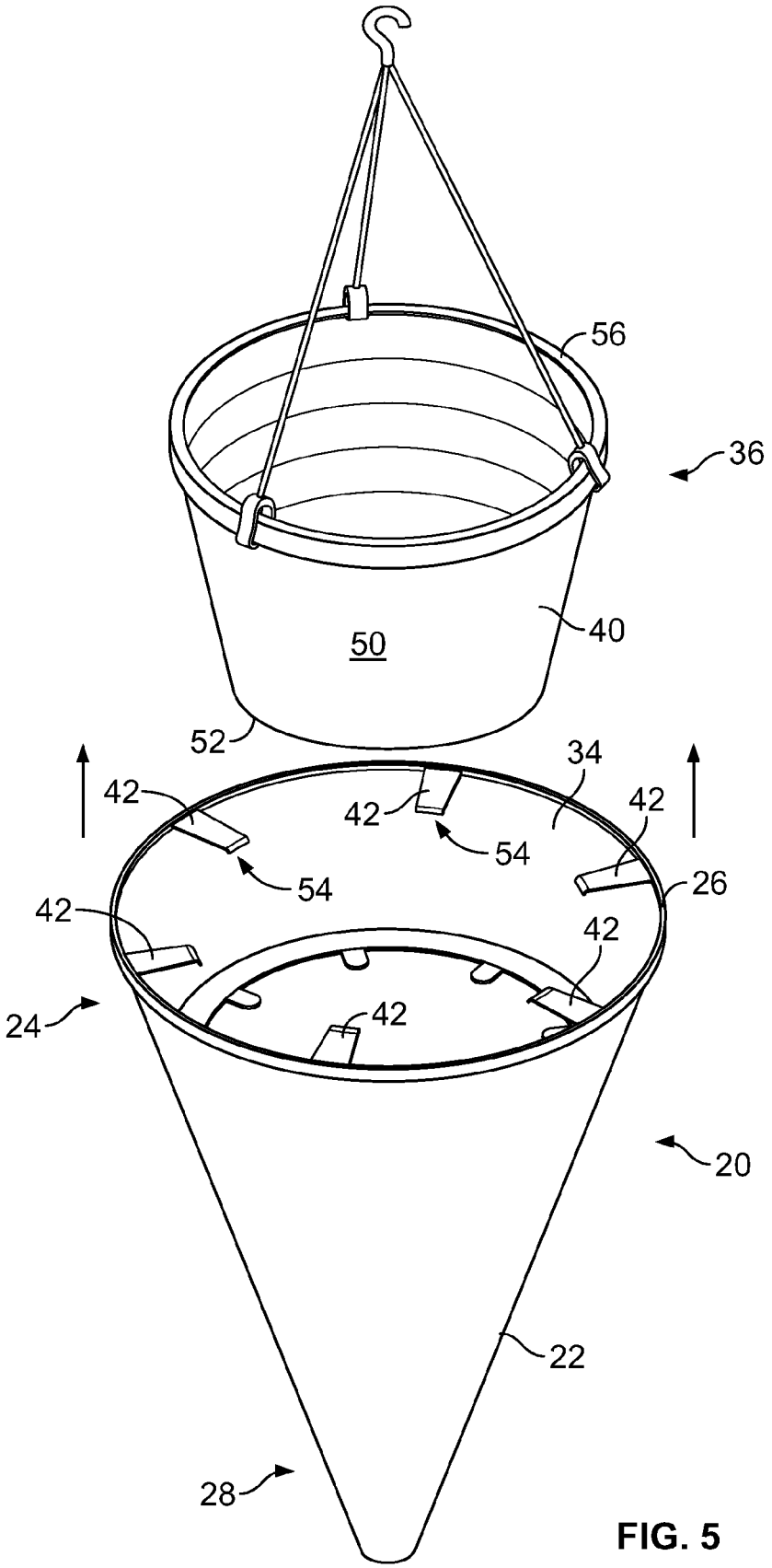
FIG. 5 is a perspective view of the cover of FIG. 1 being inserted over a hanging basket.
Figure 6:
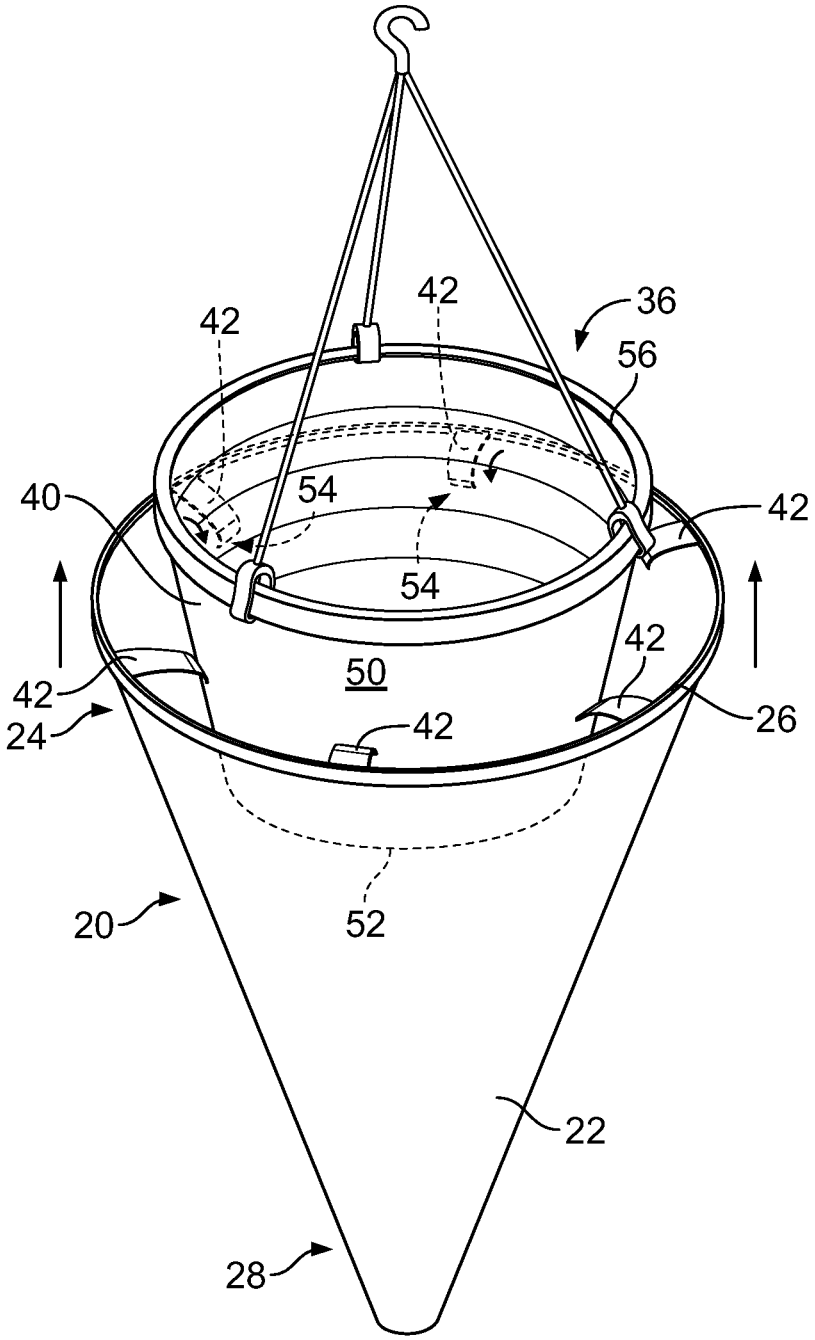
FIG. 6 is a fragmentary perspective view of the cover of FIG. 5 engaging the hanging basket.
Figure 7:
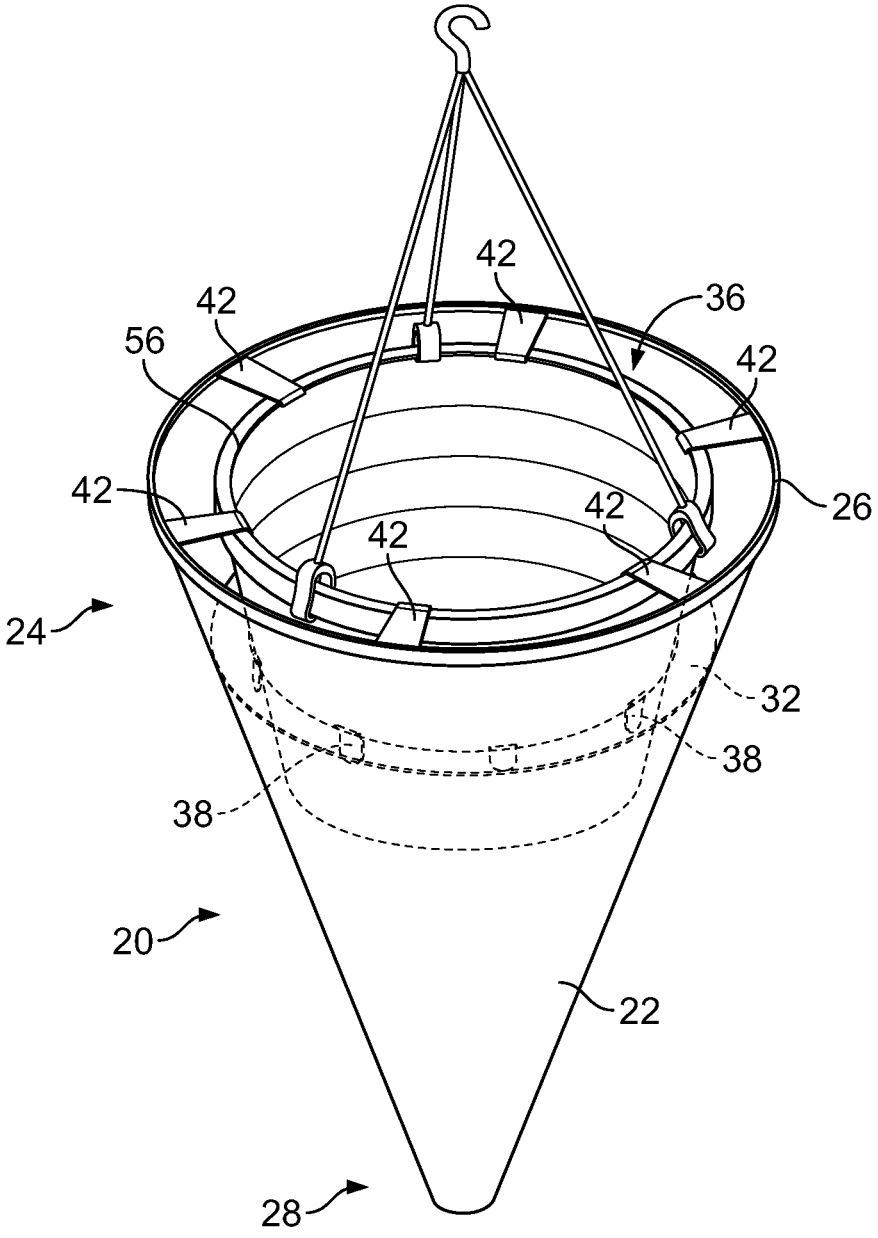
FIG. 7 is a perspective view of the cover of FIG. 5 fully covering and secured to the hanging basket.

Referring now to FIGS. 5-8, the present cover 20, and more specifically, the body 22 is axially aligned with and positioned beneath a hanging basket 36 as shown in FIG. 5. The cover 20 is then moved upwardly against the body 50 of the hanging basket 36 causing the arms 42 to flex to the downwardly flexed position shown in FIG. 6. More specifically, as a bottom end 52 of the basket 36 engages the arms 42 of the cover 20, the upward movement of the cover 20 relative to the basket 36 causes the basket body 50 to push against and bend or flex the arms to the downwardly flexed position (FIG. 6). The arms 42 remain in the downwardly flexed position as the cover 20 is moved over the hanging basket 36 while moving or sliding along the outer surface 40 of the basket. As described above, the support ring 32 is positioned at a distance below the top edge 26 of the body 22 so that the middle to bottom portion of the basket 36 contacts the tabs 38 of the support ring 32 and correspondingly moves or flexes the tabs 38 from a rest position (FIG. 1) to a downwardly flexed position (FIG. 7). The tabs 38 contact and guide the basket 36 to generally align the basket along the central longitudinal axis 49 of the body 22 (see FIGS. 3 and 7). The cover 20 is moved or slid over the basket 36 until ends 54 of the arms 42 move completely past a top edge 56 of the basket 36 and return to the rest position as shown in FIG. 7. In the rest position, the arms 42 extend over the top edge 56 of the basket 36 such that the arms help to prevent the basket from moving out of or separating from the cover 20. Furthermore, the stops 46 act to at least partially block and limit lateral movement of the cover 20 relative to the basket 36 and also help to prevent the top edge 56 of the basket 22 from sliding beyond one or more of arms 42.

In particular, the arms 42 are sized to accommodate different sized baskets 36. For example, hanging baskets may have different diameters. In such cases, the arms 42 are made to extend from the body 22 of the cover 20 a designated distance to accommodate different diameters of hanging baskets.

Further, the cover 20, and more specifically, the flexible arms 42 and the tabs 38 are constructed so that the cover can be removed and installed on a different hanging basket 36 or replaced by a different cover if a user wants to change the appearance of the basket or if the cover 20 has been damaged during use. To remove the cover 20 from the hanging basket 36, a user grabs the body 22 and pulls downwardly on the body, which causes the arms 42 to move or flex form the rest position to the upwardly flexed position (FIG. 8). The downward movement of the cover 20 causes the top edge 56 of the basket 36 to engage and push the arms 42 upwardly so that the arms disengage from the top edge of the basket and slide along the outer surface 40 of the basket 36. In some situations, a user may have to manually pull or flex one or more of the tabs 38 outwardly to enable one or more of the stops 46 on the arms 42 to move over or clear the top edge 56 of the basket 36.

Figure 9:
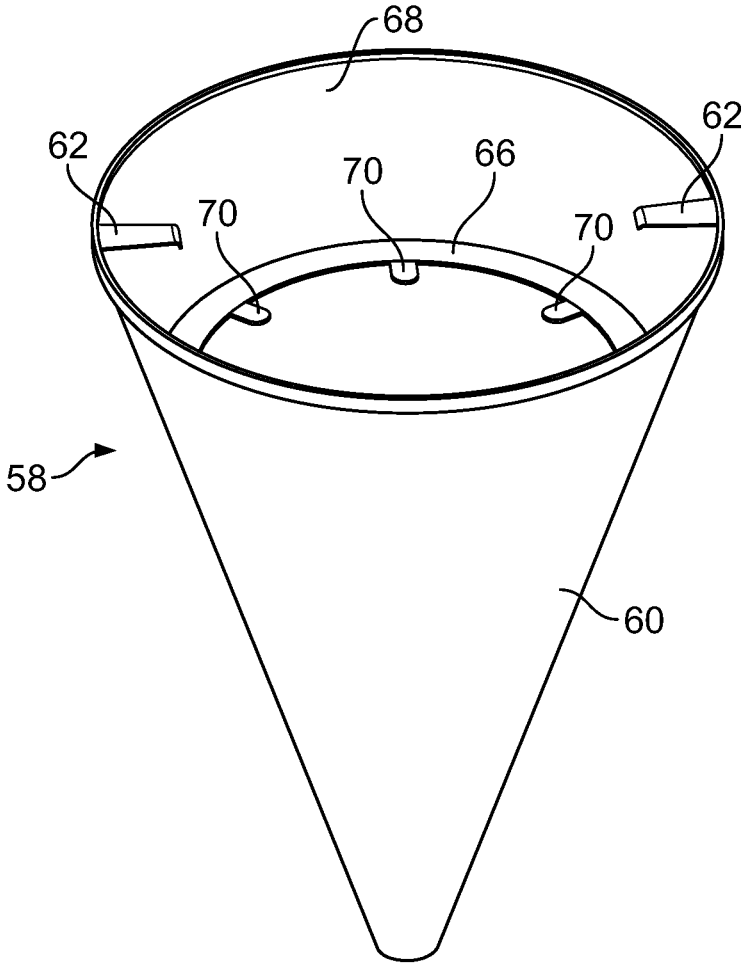
FIG. 9 is a perspective view of another embodiment of the present hanging basket cover.

Referring now to FIG. 9, another embodiment of the present cover generally indicated as 58 is illustrated where the cover 58 includes a body 60 having two opposing flexible arms 62 transversely extending from a top edge 64 of the cover. Also, a support ring 66 is integrally formed with an inner surface 68 of the body 60 and includes a plurality of flexible tabs 70 as described above that align or center a basket 36 within the cover. In this embodiment, the flexible arms 42 are spaced 180 degrees from each other but may be spaced at any suitable distance from or angle relative to each other.

While particular embodiments of the present cover have been described herein, it will be appreciated by those skilled in the art that changes and modifications may be made thereto without departing from the invention in its broader aspects.

What is claimed is:

1. A hanging basket cover comprising:

an integrally formed body including a first, open end, an opposing second end and an inner surface, said body including a flat, outer surface that extends inwardly from said first end to said second end along an entire length of said body, and a diameter that decreases from said first end to said second end;

at least two flexible arms transversely extending from said first end of said body, each of said arms including a first end attached to said body and an opposing, second end including a stop extending transversely from said second end, said arms being movable between a rest position and a flexed position, and a support ring positioned between said first end and said second end of said body, and extends inwardly from said inner surface of said body, said support ring including a plurality of tabs that extend radially inwardly, wherein the hanging basket is inserted in said first end of said body and against said flexible arms causing said flexible arms to move to said flexed position for allowing the hanging basket to move into said body until said flexible arms extend over a top edge of the hanging basket to secure said body to the hanging basket, wherein said plurality of tabs of said support ring contact and align the hanging basket within said body, wherein each of said stops of said flexible arms engage an inner edge of the hanging basket to limit lateral movement of the hanging basket relative to the body.

2. The hanging basket of claim 1, wherein said plurality of tabs are spaced equidistant from each other on said support ring.

3. The hanging basket of claim 1, wherein said body has a cone shape.

4. The hanging basket of claim 1, wherein said second end includes an opening.

5. The hanging basket of claim 1, wherein an outer surface of said body includes at least one decorative element.

6. The hanging basket of claim 1, wherein said at least two flexible arms are spaced 180° from each other on said body.

7. The hanging basket of claim 1, wherein said plurality of flexible arms are spaced equidistant from each other on said body.

8. The hanging basket of claim 1, wherein at least one of said body and said two flexible arms are made of plastic.

9. A hanging basket cover comprising:

an integrally formed body including a first open end, a second opposing end and an inner peripheral surface, said body including a designated shape and a flat, outer surface that angles inwardly from said first end to said second end along an entire length of said body:

at least two arms adjacent to said open end, said arms transversely extending from and hingedly connected to said body, wherein said at least two arms move between a rest position and one of an upward flexed position and a downward flexed position, each of said arms including a first end attached to said body and an opposing, second end including a stop extending transversely from said second end; and a support ring spaced from the first open end and the second end such that the support ring is positioned between the first open end and the second end of said body, said support ring extending along the entire inner peripheral surface and transversely extending inwardly from the inner peripheral surface of said body, and including a plurality of flexible tabs configured to move between a rest position and one of an upward flexed position and a downward flexed position based on the movement of the hanging basket relative to said body, wherein the tabs are configured to engage a sidewall of the hanging basket and align the hanging basket within said body, wherein, when in use, a hanging basket is inserted into said first, open end of said body and against said plurality of flexible tabs of said support ring and at least two arms and against said tabs causing said at least two arms and said tabs to move from said rest position to said downward flexed position for allowing the hanging basket to move into said body until said at least two arms extend over a top edge of the hanging basket and move to said rest position for securing said body to the hanging basket, wherein each of said tabs remain in the downward flexed position against an outer surface of the hanging basket and each of said stops engage an inner edge of the hanging basket to limit lateral movement of the hanging basket relative to said body, and wherein said body is removed from the hanging basket by disengaging said stops from the inner edge of the hanging basket and moving the body downwardly relative to the hanging basket causing said at least two arms to move to said upward flexed position until body is separated from the hanging basket, said body maintaining said designated shape when the hanging basket is inserted into said body and when said body is removed from the hanging basket.

10. The hanging basket of claim 9, wherein said body includes an opposing second end including at least one opening.

11. A hanging basket cover comprising:

an integrally formed body including a first, open end, an opposing second open end and an inner surface extending therebetween, said body including an outer surface that angles inwardly from said first end to said second end along a length of said body, and a diameter that decreases from said first end to said second end;

at least two flexible arms transversely extending from said first end of said body, each of said arms including a first end attached to said body and an opposing, second end including a stop extending transversely from said second end, said arms being movable between a rest position and a flexed position; and a plurality of flexible tabs extending radially inwardly from said inner surface of said body, wherein said plurality of flexible tabs and said at least two flexible arms are different, wherein a hanging basket is inserted in said first end of said body and against said flexible arms causing said flexible arms to move to said flexed position for allowing the hanging basket to move into said body until said flexible arms extend over a top edge of the hanging basket to secure said body to the hanging basket, wherein said plurality of flexible tabs are configured to contact a portion of the hanging basket between the top and bottom ends of the hanging basket to align the hanging basket within said body, and wherein each of said stops engage an inner edge of the hanging basket to limit lateral movement of the hanging basket relative to the body.

12. The hanging basket of claim 11, wherein said plurality of flexible tabs are spaced equidistant from each other.

13. The hanging basket of claim 11, wherein an outer surface of said body includes at least one decorative element.

14. The hanging basket of claim 11, wherein said at least two flexible arms are spaced 180° from each other on said body.

* * * * *